US007270114B2

(12) United States Patent
Mattes et al.

(10) Patent No.: US 7,270,114 B2
(45) Date of Patent: Sep. 18, 2007

(54) FUEL INJECTION SYSTEM FOR INTERNAL COMBUSTION ENGINES

(75) Inventors: Patrick Mattes, Stuttgart (DE); Hans Brekle, Erdmannhausen (DE)

(73) Assignee: Robert Bosch GmbH, Stuttgart (DE)

( * ) Notice: Subject to any disclaimer, the term of this patent is extended or adjusted under 35 U.S.C. 154(b) by 32 days.

(21) Appl. No.: 10/556,310

(22) PCT Filed: Mar. 31, 2004

(86) PCT No.: PCT/DE2004/000665

§ 371 (c)(1),
(2), (4) Date: Nov. 9, 2005

(87) PCT Pub. No.: WO2004/111431

PCT Pub. Date: Dec. 23, 2004

(65) Prior Publication Data

US 2007/0012293 A1 Jan. 18, 2007

(30) Foreign Application Priority Data

May 22, 2003 (DE) ..... 103 23 177

(51) Int. Cl.
*F02M 59/46* (2006.01)

(52) U.S. Cl. ..... 123/467; 123/514

(58) Field of Classification Search ..... 123/514, 123/516, 446, 467, 506
See application file for complete search history.

(56) References Cited

U.S. PATENT DOCUMENTS 3,625,192 A * 12/1971 Dreisin ..... 123/495
3,997,117 A * 12/1976 Kohler et al. ..... 239/533.8
4,213,434 A 7/1980 Vogtmann et al.
4,440,135 A * 4/1984 Asami ..... 123/467
5,487,508 A * 1/1996 Zuo ..... 239/533.5
6,092,722 A * 7/2000 Heinrichs et al. ..... 235/375
6,112,721 A 9/2000 Kouketsu et al.
6,644,281 B2 * 11/2003 Boehland ..... 123/467
6,644,282 B2 * 11/2003 Schwarz ..... 123/467
6,659,086 B2 * 12/2003 Rodriguez-Amaya et al. ..... 123/467
6,705,291 B2 * 3/2004 Rueger et al. ..... 123/467
7,040,293 B2 * 5/2006 Furukubo et al. ..... 123/467
2003/0234007 A1 * 12/2003 Hokazono et al. ..... 123/478

FOREIGN PATENT DOCUMENTS

DE 199 41 703 A1 3/2001
DE 101 04 634 A1 9/2002

* cited by examiner

*Primary Examiner*—Carl S. Miller
(74) *Attorney, Agent, or Firm*—Ronald E. Greigg

(57) ABSTRACT

A fuel injection system for internal combustion engines having a plurality of fuel injectors, in which the fuel injectors each have one high-pressure connection and one low-pressure connection, and the low-pressure connections discharge into at least one manifold line. The system has a means, located between the manifold line and a pressureless fuel return, for maintaining the fuel pressure; at least one throttle is located between the low-pressure connection of each fuel injector and the means for maintaining the fuel pressure.

11 Claims, 2 Drawing Sheets

FUEL INJECTION SYSTEM FOR INTERNAL COMBUSTION ENGINES

CROSS-REFERENCE TO RELATED APPLICATIONS

This application is a 35 USC 371 application of PCT/DE 2004/000665 filed on Mar. 31, 2004.

BACKGROUND OF THE INVENTION

1. Field of the Invention

This invention relates to an improved fuel injector system for internal combustion engines.

2. Description of the Prior Art

In storage-type injection, or "common rail injection of fuel into an internal combustion engine ", pressure generation and injection are conventionally decoupled from one another. The injection pressure is generated independently of the engine rpm and of the injection quantity and is available in the "rail"—that is, the fuel reservoir—for injection. The instant of injection and the injection quantity are calculated in the electronic control unit and are converted by an injector at each engine cylinder. The injector has the task of adjusting the injection onset and the injection quantity.

Besides triggering the injector via a piezoelectric element, triggering the injector via a magnet valve is also known. While in magnet valves sufficiently long valve strokes can be generated for using the magnet valve as a control valve, in control of an injector with a piezoelectric element additional provisions must be made. The reason is that with a piezoelectric element, only a very short stroke, which is in the range of only some thousandths of the length of the piezoelectric element, can be generated. For the actuation of the adjusting valve, this short stroke must be transformed during continuous operation of the injector. For this purpose, a hydraulic booster is for instance used.

In the prior art, control and leakage quantities from the injector or injectors are carried away via a pressureless fuel return and fed into the fuel tank. In some injectors for diesel engines, the leak fuel in the injector must have a defined pressure, however. These injectors include piezoelectrically controlled common rail injectors. In these injectors, a hydraulic coupler is located between the piezoelectric actuator and the control valve and lengthens the adjustment path of the piezoelectric actuator. To that end, there is a coupling chamber, whose filling requires a defined leak fuel pressure that is above the ambient pressure.

From German Patent Disclosure DE-A 199 52 513, a fuel injection system for internal combustion engines is known, having at least one injector which communicates with a pressureless fuel return. Between the injector or injectors and the fuel return, there are means for maintaining a leak fuel pressure in the injector or injectors. In particular, the means for maintaining a leak fuel pressure are located in the injector or injectors of one or more pressure holding valves.

German Patent Disclosure DE-A 101 04 634 relates to a fuel injection system for internal combustion engines having a plurality of injectors, in which the injectors each have one high-pressure connection and one low-pressure connection, and the low-pressure connections discharge into a manifold line, with a pressure holding valve located between the manifold line and a pressureless fuel return; the manifold line is embodied as a pressure reservoir.

In these fuel injection systems of the prior art, the pressure load on the pressure holding valve for maintaining the pressure on the low-pressure side of the injectors, at up to 20 bar, is very high. Both the manifold line (return rail) and the actuator and a bellows that may be present are exposed to severe stresses from this pressure as well.

SUMMARY OF THE INVENTION

The fuel injection system of the invention avoids the disadvantages that occur in the prior art and enables a pressure relief of a plurality of system components, in particular the actuator and/or the manifold line and/or the pressure holding valve and/or the bellows. Another advantage is that the fuel injection system of the invention can be used for common rail systems, in which either at least one pressure holding valve or at least one electric fuel pump puts the injector coupling chamber, for filling, under a pressure required for that. The pressure holding valve may optionally be omitted, providing a cost saving; the functional scope is maintained even without pressure holding valves. Further advantages of the fuel injection system of the invention are that no additional moving internal parts are needed, thus avoiding both wear and a high production cost. In addition, no additional adjustment procedures as in the fuel injection system of the prior art are needed.

These advantages are attained according to the invention by a fuel injection system for internal combustion engines having a plurality of fuel injectors, in which the fuel injectors each have one high-pressure connection and one low-pressure connection, and the low-pressure connections discharge into at least one manifold line, the system having a means, located between the manifold line and a pressureless fuel return, for maintaining the fuel pressure; at least one throttle is located between the low-pressure connection of each fuel injector and the means for maintaining the fuel pressure.

The at least one throttle assures that the necessary pressure on the low-pressure side of the injector at high load points will be established. At low load points, this is assured by the means for maintaining the fuel pressure. Since the high pressures are represented by the throttle, downstream of the throttle only the lesser pressures of the means for maintaining the fuel pressure are required, which then also brings about the substantial relief of the entire low-pressure system.

Besides the advantages discussed above, the fuel injection system of the invention has the further advantage that the production cost for the at least one throttle is very low.

In a variant of the invention, it is provided that all the injectors communicate with one common manifold line via their low-pressure connections. There can then be a connecting line between the manifold line and each individual injector, so that the manifold line can be designed with a short length and simple geometry. In the variant of the fuel injection system of the invention with a single manifold line for all the injectors, it suffices to provide a throttle between the low-pressure connection of the injector and the means for maintaining the fuel pressure, in particular in the common manifold line.

In another feature of the invention, a plurality of manifold lines are provided. For instance, each bank of cylinders of a V engine can be assigned its own manifold line. This version of the fuel injection system of the invention may have advantages in terms of the installation space required and the expenses for connecting the low-pressure connections of the injectors to the respective manifold line. Using a plurality of independent manifold lines requires that at least one throttle be provided per manifold line between the low-pressure connection of each injector and the respective means for maintaining the fuel pressure, and in particular that one throttle be disposed in each manifold line.

In a preferred embodiment of the present invention, the means for maintaining the fuel pressure is a pressure holding valve. Pressure holding valves are time-tested, mature components to which recourse can be had. Preferably, in the fuel injection system of the invention with a pressure holding valve, a throttle is located upstream of the inlet, toward the injectors, of the pressure holding valve. Even with the throttle positioned upstream of the pressure holding valve, the functional scope of the pressure holding valve is preserved, yet compared to the prior art, a pressure relief of the pressure holding valve still occurs. Moreover, the throttle produces a pressure relief of further system components, in particular the manifold line, the actuator, and the bellows.

The bellows is embodied such that it can absorb the axial stroke of the actuator, in particular a piezoelectric actuator, for controlling the injector. The bellows is solidly joined to the actuator and the actuator bore, so that fluid-tight sealing of the actuator module off from the other regions of the injector is achieved.

In a further preferred embodiment of the present invention, the means for maintaining the fuel pressure is an electric fuel pump. In the prior art, electric fuel pumps are known, time-tested pumps, which are embodied in modular fashion and located in the tank of a motor vehicle and are used particularly for internal combustion engines in order to deliver enough fuel to them under all operating states. In the fuel injection system with an electric fuel pump, a throttle is preferably located in the manifold line upstream of the electric fuel pump. In this variant of the present invention, the functional scope is still present even without a pressure holding valve, so that no pressure holding valve is required, thus reducing costs.

In a variant of the invention, the high-pressure connections of the injectors are supplied with fuel by at least one common rail, so that the advantages of the fuel injection system of the invention come into play with so-called common rail injection systems as well.

In an augmentation of the invention, it is provided that the injectors each include one piezoelectric element for controlling the injector and one hydraulic booster for boosting the stroke of the piezoelectric element. By way of this embodiment of the invention, the piezoelectric element stroke can be transmitted to an injector needle, preferably via a hydraulic medium, in particular fuel, in a coupling chamber of the hydraulic booster; the coupling chamber can be filled with the hydraulic medium via the at least one throttle. Because the fuel injection system of the invention has at least one throttle between the low-pressure connection of the injector and the means for maintaining the fuel pressure (in particular the pressure holding valve or the electric fuel pump), the pressure required for filling the coupling chamber is established at high load points. At low load points, this is assured by the pressure holding valve or the electric fuel pump. Since the high coupler filling pressures are attained by the throttle, downstream of the throttle only the low pressures of the pressure holding valve or the electric fuel pump are required, which then also brings about the substantial relief of the entire low-pressure system. By the choice of the throttle diameter, the opening pressure of the pressure holding valve, and the pressure of the electric fuel pump, the pressure for the coupler filling can be applied as needed.

BRIEF DESCRIPTION OF THE DRAWINGS

The invention is described in further detail below in conjunction with the drawings, in which.

DESCRIPTION OF THE PREFERRED EMBODIMENTS

Figure 1:
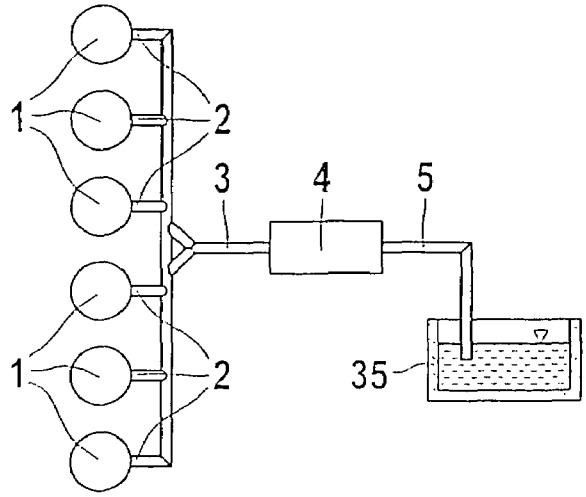
FIG. 1 is a schematic illustration of a fuel injection system according to the prior art.

FIG. 1 schematically illustrates a fuel injection system according to the prior art, with six cylinders 1, which are represented schematically as circles. Each cylinder 1 is assigned an injector (not shown), which has a low-pressure connection 2. The low-pressure connections 2 discharge into a manifold line 3. The manifold line 3 is embodied as a pressure reservoir, in which the pressure required on the low-pressure side of the injector is maintained. The manifold line 3 communicates, via a schematically shown pressure holding valve 4, with the pressureless fuel return 5, so that the same fuel pressure, which is above the ambient pressure, prevails in all the injectors. For example, the pressure holding valve does not open until at a pressure of 10 bar, so that the fuel pressure in the manifold line 3 amounts to at least 10 bar.

Figure 2:
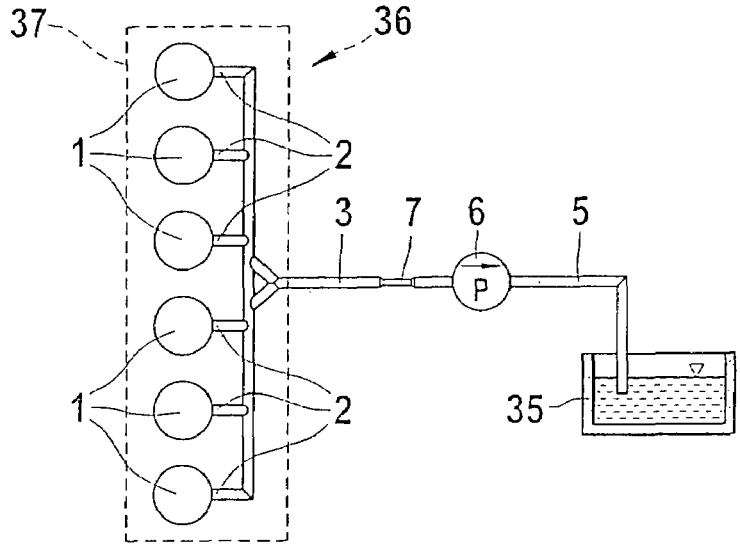
FIG. 2 is a view similar to FIG. 1 showing a fuel injection system of the invention, with an electric fuel pump.
Figure 4:
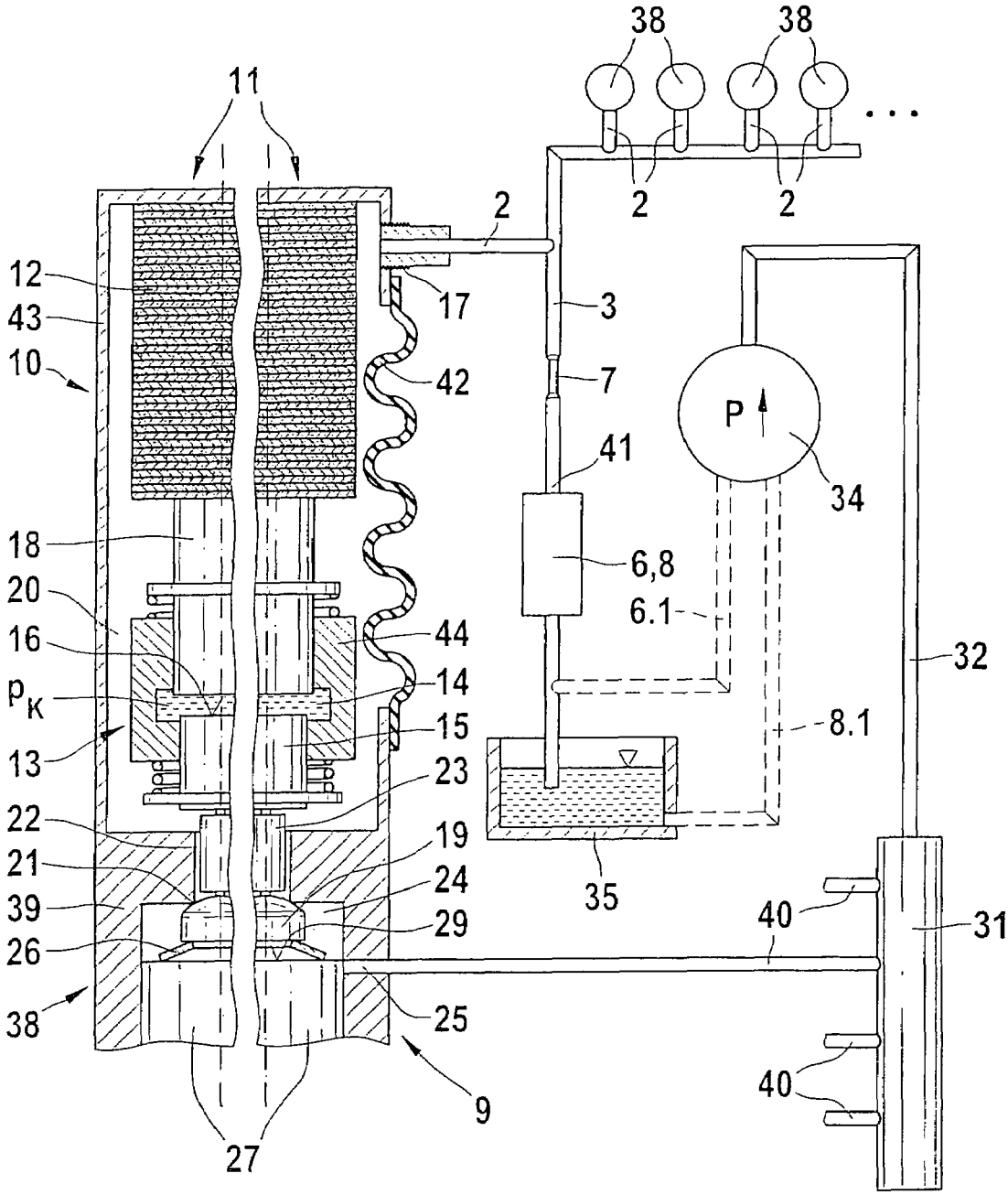
FIG. 4 is a section through a fuel injector, which is subjected to fuel at high pressure via a high-pressure collection chamber (common rail) and is triggered by an actuator embodied as a piezoelectric actuator.

FIG. 2 shows a fuel injection system of the invention with an electric fuel pump employed with an internal combustion engine 36, shown only schematically and including six cylinders 1, which are each subjected to fuel at high pressure via a respective fuel injector 38, shown in further detail in FIG. 4. The fuel injectors are disposed in the cylinder head region 37 of the engine 36. Between the manifold line 3 and the pressureless fuel return 5, which is in communication with a fuel tank 35 of a vehicle, there is an electric fuel pump 6, as the means for maintaining the fuel pressure in this variant embodiment of the invention. There is also a throttle 7 in the manifold line 3, upstream of the electric fuel pump 6. In this combination of a throttle 7 and an electric fuel pump 6, no pressure holding valve is required for maintaining the fuel pressure on the low-pressure side of the injectors. Moreover, the electronic fuel pump 6 needs to pump only fuel at a low pressure. For instance, for a cross section of the throttle 7 of 0.5 mm, a 5-bar electric fuel pump 6 suffices.

Figure 3:
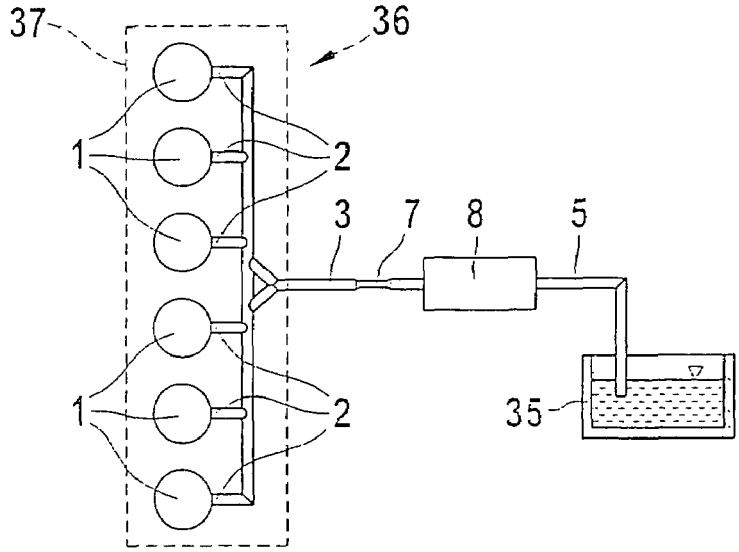
FIG. 3 is a fuel injection system of the invention, with a pressure holding valve.

FIG. 3 shows a fuel injection system of the invention with a pressure holding valve, in which the internal combustion engine 36 may for instance be designed as a 6-cylinder engine, but the variant embodiment as a 6-cylinder engine is shown only as an example. Depending on the design, engines with four, five, eight or 10 or 12 cylinders may also be supplied with the fuel injection system proposed according to the invention. In this version of the present invention, as the means for maintaining the fuel pressure, a pressure holding valve 8 is provided between the manifold line 3 and the pressureless fuel return 5 that discharges into the fuel tank 35 of a motor vehicle. A throttle 7 is also located in the manifold line 3, upstream of the pressure holding valve 8. With this combination of the throttle 7 and pressure holding valve 8, the pressure holding valve 8 is pressure-relieved, so that it can have a lesser opening pressure. For instance, for a throttle 7 with a cross section of 0.5 mm, a 5-bar pressure holding valve suffices to maintain the requisite fuel pressure on the low-pressure side of the injectors.

In the illustration in FIG. 4, a fuel injector can be seen, which is in communication with a high-pressure collection chamber (common rail) and which can be actuated via an actuator embodied as a piezoelectric actuator.

The fuel injector 38 shown in FIG. 4 includes a high-pressure system 9 and a low-pressure system 10. The actuation of the fuel injector 38 is effected via an actuator 11, which in the view shown in FIG. 4 is provided with a schematically indicated piezoelectric crystal stack 12, which lengthens when electrical current is supplied to it. The piezoelectric crystal stack 12 acts on an adjusting piston 18. The adjusting piston 18 acts on a hydraulic booster 13. The hydraulic booster 13 amplifies the only short stroke of the piezoelectric crystal stack 12 when current is supplied to the actuator 11. The hydraulic booster 13 includes an actuating piston 15, whose end face 16 protrudes into the hydraulic coupling chamber 14 of the hydraulic booster 13. The piezoelectric crystal stack 12 of the actuator 11 and the coupling chamber 14 of the hydraulic booster can both be surrounded by a thin wall 43 or a bellows 42, with which the relative motion of the piezoelectric crystal stack 12 when current is supplied to it and of the adjusting piston 18 connected to it is made possible relative to the hydraulic coupling chamber 14.

If a bellows 42 is used, on the one hand a relative motion of the piezoelectric crystal stack 12 with respect to the hydraulic coupling chamber 14 that is integrated with the housing of the fuel injector 38 and on the other sealing between the components 12 and 14 that are movable relative to one another are attained. The hydraulic coupling chamber 14 is surrounded by a booster housing 44 and is subjected to the coupling chamber pressure $P_K$. From a system chamber 20, which surrounds both the piezoelectric crystal stack 12 and the hydraulic booster 13, 44, the low-pressure connection 2 extends to the manifold line 3. As shown in FIGS. 2 and 3, the respective low-pressure connections 2 of the further cylinders 1 of the engine 36 discharge into the manifold line 3. The manifold line 3 extends to the means for maintaining the fuel pressure, which in the variant embodiments schematically indicated in FIGS. 2 and 3 may be embodied either as a pressure holding valve 8 as an the electric fuel pump 6 for supplying the engine 36 with fuel or for acting on a high-pressure pump 34. The throttle restriction 7 is received in the manifold line 3, into which the various low-pressure connections 2 of the cylinders 1 coming from the fuel injectors 38 discharge, and the means 6, 8 for maintaining the fuel pressure in the system chamber 20. The low-pressure connection 2 may for instance be embodied as a screw means, so that at the pressures that prevail within the system pressure chamber 20, leakage-free sealing is assured between the system chamber 20 and the low-pressure connection 2.

As shown in FIG. 4, the hydraulic booster 13 includes a housing 44, which defines the hydraulic coupling chamber 14. The housing 44 is braced on one side, via a helical spring, on a support disk that is received on the adjusting piston 18 of the actuator 11, and on the other side, prestressed via a further helical spring, it is braced on a support disk which is received on the actuating piston 15. The diameter of the adjusting piston 18 is designed as larger than the diameter of the actuating piston 15, so that a hydraulic pressure boosting is achieved by the interpolation of the hydraulic coupling chamber 14. The actuating piston 15 acts on a guide piston 23. The guide piston 23 is in turn guided in an outlet conduit 22, which is provided in the housing 39 of the fuel injector 38. Via the outlet conduit 22, the system chamber 20 and the control chamber 24 communicate with one another. The outlet conduit 22, which connects the system chamber 20 and the control chamber 24 to one another, is closed and opened via a closing element 19. The closing element 19, in the view shown in FIG. 4, is put into its closing position, that is, its closing element seat 21, which is embodied at the point where the outlet conduit 22 discharges into the control chamber 24. On one face end, the closing element 19, which can for instance be embodied hemispherically, is prestressed via a spring element 26. The spring element 26, which may be a cup spring, is braced on a face end 29 of an injection valve member 27 embodied in the form of a needle. The control chamber 24 is always acted upon by fuel at high pressure via a high-pressure line, which is connected to one of the high-pressure connections 40 of a high-pressure collection chamber 31 (common rail). The high-pressure collection chamber 31 is subjected to fuel at high pressure in turn via a supply line 32 via a high-pressure pump 34 and stores this fuel at high pressure. The high-pressure pump 34 may—depending on the configuration of the injection system of the engine 36—be preceded by an electric fuel pump 6 acting as a prefeed pump.

The system chamber 20 of the fuel injector 38, on its low-pressure side 10, may be defined on one side by a thin-walled wall 43; on the other side, the system chamber 20 may also be sealed off by a bellows 42. The embodiment of a boundary of the system chamber 20 via a deformable bellows 42 in particular advantageously affords the possibility of compensating for elongations that occur because of an increase in length of the piezoelectric crystal stack 12 when current is supplied to the actuator, while simultaneously maintaining the sealing action. Via the pressure prevailing in the system chamber 20, filling of the hydraulic coupling chamber 14 is effected. Between the housing 44, which surrounds the hydraulic coupling chamber 14, and the actuating piston 15 and the adjusting piston 18, gaps are formed by way of which the fuel volume on the low-pressure side 10 of the fuel injector 38 also enters the hydraulic coupling chamber 14 for initially filling it.

First, the situation in which the fuel injection system shown in FIG. 3 for direct-injection internal combustion engines includes a pressure holding valve 8 on the low-pressure side 10 of the fuel injector 38 will be considered.

If in a fuel injection system configured in this way for direct-injection internal combustion engines 36, the control chamber 24 is pressure-relieved by way of current being supplied to the actuator 11, fuel flows out of the control chamber 24 into the system chamber 20 via the outlet conduit 22. From the system chamber 20, the fuel volume diverted from the control chamber 24 flows via the connection 17 into the low-pressure connection 2. All the low-pressure connections 2 of the fuel injectors 38 discharge into the manifold line 3. The further fuel injectors 38 of the engine 36 are shown only schematically in FIG. 4. In the manifold line 3, the throttle 7 is received upstream of the inlet 41, toward injectors, of the pressure holding valve 8. By means of the throttle restriction 7 in the manifold line 3, it can advantageously be assured that the pressure required for filling the hydraulic coupling chamber 14 will be established at high load points. At low load points, conversely, the pressure level required for filling the hydraulic coupling chamber 14 can be brought to bear via the pressure holding valve 8. At low load points, the pressure level on the low-pressure side 10 of the fuel injector 38 in the system chamber 20 is dimensioned such that filling of the hydraulic coupling chamber 14 can be effected via the gaps between the housing 44 and the adjusting piston 18, on the one hand, and via the gaps between the actuating piston 15 and the housing 44 of the pressure booster 13. At low load points, downstream of the throttle 7 only the low pressures that can be generated by the pressure holding valve now prevail, as a result of which the substantial relief of the low-pressure side 10 of the fuel injector 38 is achieved. With the dimensioning of the diameter of the throttle restriction 7 or of the opening pressure of the pressure holding valve 8—in this configuration of a fuel injection system—it is possible if needed to adjust the pressure required for filling the hydraulic coupling chamber 14 via the system chamber 20.

In the variant embodiment described above of a fuel injection system for internal combustion engines, the feeding of fuel from the fuel tank 35 to the high-pressure pump 34, in which compression of the fuel to a very high pressure of approximately 1500 bar and more takes place, is effected via a first fuel supply line 8.1.

If in a variant of a fuel injection system, an electric fuel pump 6, which in this case represents the means for holding the pressure, is provided, then upon a pressure relief of the control chamber 24 by provision of current supply to the actuator 11, an outflow of fuel volume from the control chamber 24 into the system chamber 20 takes place, analogously to the variant embodiment described above of a fuel system with a pressure holding valve 8. From the system chamber 20, the fuel flows via the connection 17 into the low-pressure connection 2, which applies to all the fuel injectors 38, which are provided for the engine in a number matching the number of cylinders of the engine 36 to be supplied with fuel. In this case, in the manifold line 3, into which all the low-pressure connections 2 of the fuel injectors 38 discharge, a throttle restriction 7 is again embodied. The throttle restriction 7 is located at the discharge point of all the low-pressure connections 2 into the manifold line 3, upstream of the inlet-side end 41 of the electric fuel pump 6 acting as a prefeed pump. The electric fuel pump 6 pumps fuel out of the fuel tank 35 and via the second fuel supply line 6.1 to the high-pressure pump 34. The high-pressure pump 34 in turn, via the supply line 32, subjects the high-pressure collection chamber 31 (common rail) to fuel that is at very high pressure. The fuel level is in the range between about 1500 and 1600 bar.

In this case, by means of the throttle restriction 7, it is attained at high load points that because of the pressure prevailing in the system chamber 20, filling of the hydraulic coupling chamber 14 is established via the leakage gaps between the positive displacement piston 18 and the housing 44, and between the actuating piston 15 and the housing 44. At low load points, the pressure required for filling the coupler can be maintained by the electric fuel pump 6, serving as a prefeed pump. As a result, downstream of the throttle restriction 7, only the slight pressures of the electric fuel pump now prevail, which can be approximately between 3 and 8 bar. As a result, a substantial relief of the low-pressure side 10 of the fuel injector 20 can be attained. By the choice of the diameter of the throttle restriction 7 in the manifold line 3 and of the feed pressure of the electric fuel pump 6, the pressure in the system chamber 20 for filling the hydraulic coupling chamber 14 through its guidance gaps can be varied if needed. If an electric fuel pump 6 together with a high-pressure pump 34 is used, then the electric fuel pump 6 associated with the fuel tank acts as a prefeed system for the high-pressure pump 34, which is not embodied as self-aspirating. In this case, the supply line 6.1 branches off from the fuel line assigned to the fuel tank 35 and leads to the high-pressure pump 34.

Various filling pressures for filling the hydraulic coupling chamber 14 of the hydraulic booster 13 can be preset to suit a particular need, by means of the design of the diameter of the throttle 7 in the manifold line 3, and the adjustment of the opening pressure of the pressure holding valve 8 and of the feed pressure of the electric fuel pump 6.

The foregoing relates to preferred exemplary embodiments of the invention, it being understood that other variants and embodiments thereof are possible within the spirit and scope of the invention, the latter being defined by the appended claims.

The invention claimed is:

1. A fuel injection system for internal combustion engines, comprising a plurality of fuel injectors each having one high-pressure connection and one low-pressure connection, the low-pressure connections each discharging into at least one manifold line, the fuel injectors each having a piezoelectric actuator, a pressureless fuel return, a means for maintaining fuel pressure in the manifold line, said means located between the manifold line and the pressureless fuel return, the fuel injectors each including a system chamber containing a hydraulic booster and hydraulic coupling chamber, the system chamber having a pressure level suitable for filling the hydraulic coupling chamber, and a throttle located in the manifold line between the low-pressure connections of the fuel injectors and the means for maintaining the fuel pressure in the manifold line.

2. The fuel injection system according to claim 1, wherein the means for maintaining the fuel pressure is embodied on the low-pressure side as a pressure holding valve.

3. A fuel injection system for internal combustion engines, comprising a plurality of fuel injectors each having one high-pressure connection and one low-pressure connection, the low-pressure connections each discharging into at least one manifold line, the fuel injectors each having a piezoelectric actuator, a pressureless fuel return, a means for maintaining fuel pressure in the manifold line, said means located between the manifold line and the pressureless fuel return, the fuel injectors each including a system chamber containing a hydraulic booster and hydraulic coupling chamber, the system chamber having a pressure level suitable for filling the hydraulic coupling chamber, and a throttle located in the manifold line between the low-pressure connections of the fuel injectors and the means for maintaining the fuel pressure in the manifold line, wherein the means for maintaining the fuel pressure is represented on the low-pressure side by an electric fuel pump.

4. The fuel injection system according to claim 1, wherein the high-pressure connections of the fuel injectors are subjected to fuel at high pressure from at least one high-pressure collection chamber.

5. The fuel injection system according to claim 1, wherein the stroke of the piezoelectric actuator can be transmitted to an injection valve member via a hydraulic medium, in particular fuel, by means of the hydraulic coupling chamber of the hydraulic booster, and the hydraulic coupling chamber can be filled with the hydraulic medium via the at least one throttle.

6. The fuel injection system according to claim 1, wherein, at relatively high load ranges of an internal combustion engine, a coupling chamber pressure $P_K$ can be maintained via the throttle in the manifold line.

7. The fuel injection system according to claim 2, wherein the pressure required for filling the hydraulic coupling chamber is maintained, at low load points of the engine, by means of the pressure holding valve.

8. The fuel injection system according to claim 3, wherein the pressure required for filling the hydraulic coupling chamber is maintained, at low load points of the engine, by means of the pressure holding valve.

9. The fuel injection system according to claim 1, wherein initial filling of the hydraulic coupling chamber is effected via leakage gaps between an actuating piston and a housing and/or via leakage gaps between an adjusting piston and the housing, the housing being surrounded by the system chamber.

10. The fuel injection system according to claim 3, wherein the electric fuel pump on the low-pressure side of the fuel injector is located upstream of a high-pressure pump.

11. The fuel injection system according to claim 2, wherein the pressure holding valve in the manifold line is located upstream of a fuel tank.

* * * * *